US006123830A

United States Patent [19]

Gupta et al.

[11] Patent Number: 6,123,830

[45] Date of Patent: *Sep. 26, 2000

[54] INTEGRATED STAGED CATALYTIC CRACKING AND STAGED HYDROPROCESSING PROCESS

[75] Inventors: Ramesh Gupta, Berkeley Heights; Edward S. Ellis, Basking Ridge, both of N.J.

[73] Assignee: Exxon Research and Engineering Co., Florham Park, N.J.

[ * ] Notice: This patent is subject to a terminal disclaimer.

[21] Appl. No.: 09/222,863

[22] Filed: Dec. 30, 1998

[51] Int. Cl.[7] ..... C10G 69/02; C10G 69/04

[52] U.S. Cl. ..... 208/76; 208/74; 208/77; 208/78; 208/89; 208/57

[58] Field of Search ..... 208/76, 74, 77, 208/89, 78, 57

[56] References Cited

U.S. PATENT DOCUMENTS

| | | | |
|---|---|---|---|
| 2,791,541 | 5/1957 | Thompson et al. | 196/49 |
| 2,953,513 | 9/1960 | Langer, Jr. | 208/56 |
| 2,956,003 | 10/1960 | Marshall et al. | 208/74 |
| 2,981,674 | 4/1961 | Good | 208/70 |
| 3,287,254 | 11/1966 | Paterson | 208/68 |
| 3,755,141 | 8/1973 | Youngblood et al. | 208/56 |
| 3,896,024 | 7/1975 | Nace | 208/74 |
| 3,928,172 | 12/1975 | Davis et al. | 208/77 |
| 4,191,635 | 3/1980 | Quick et al. | 208/89 |
| 4,551,229 | 11/1985 | Pecoraro et al. | 208/76 |
| 4,565,620 | 1/1986 | Montgomery et al. | 208/80 |
| 4,585,545 | 4/1986 | Yancey, Jr. et al. | 208/74 |
| 4,606,810 | 8/1986 | Krambeck et al. | 208/74 |
| 5,152,883 | 10/1992 | Melin et al. | 208/61 |
| 5,582,711 | 12/1996 | Ellis et al. | 208/76 |
| 5,770,043 | 6/1998 | Ellis et al. | 208/76 |
| 5,770,044 | 6/1998 | Ellis et al. | 208/76 |

*Primary Examiner*—Walter D. Griffin

*Attorney, Agent, or Firm*—Gerard J. Hughes; Michael A. Cromwell

[57] ABSTRACT

Disclosed is a catalytic cracking process that includes more than one catalytic cracking reaction step. The process integrates catalytic cracking steps with hydroprocessing in order to maximize olefins production, distillate quality and octane level of the overall cracked product. Preferably, one hydroprocessing step is included between the cat cracking reaction steps, and a portion of the hydroprocessed products, i.e., a naphtha and mid distillate fraction, is combined with cracked product for further separation and hydroprocessing. It is also preferred that the first catalytic cracking reaction step be a short contact time reaction step.

14 Claims, 1 Drawing Sheet

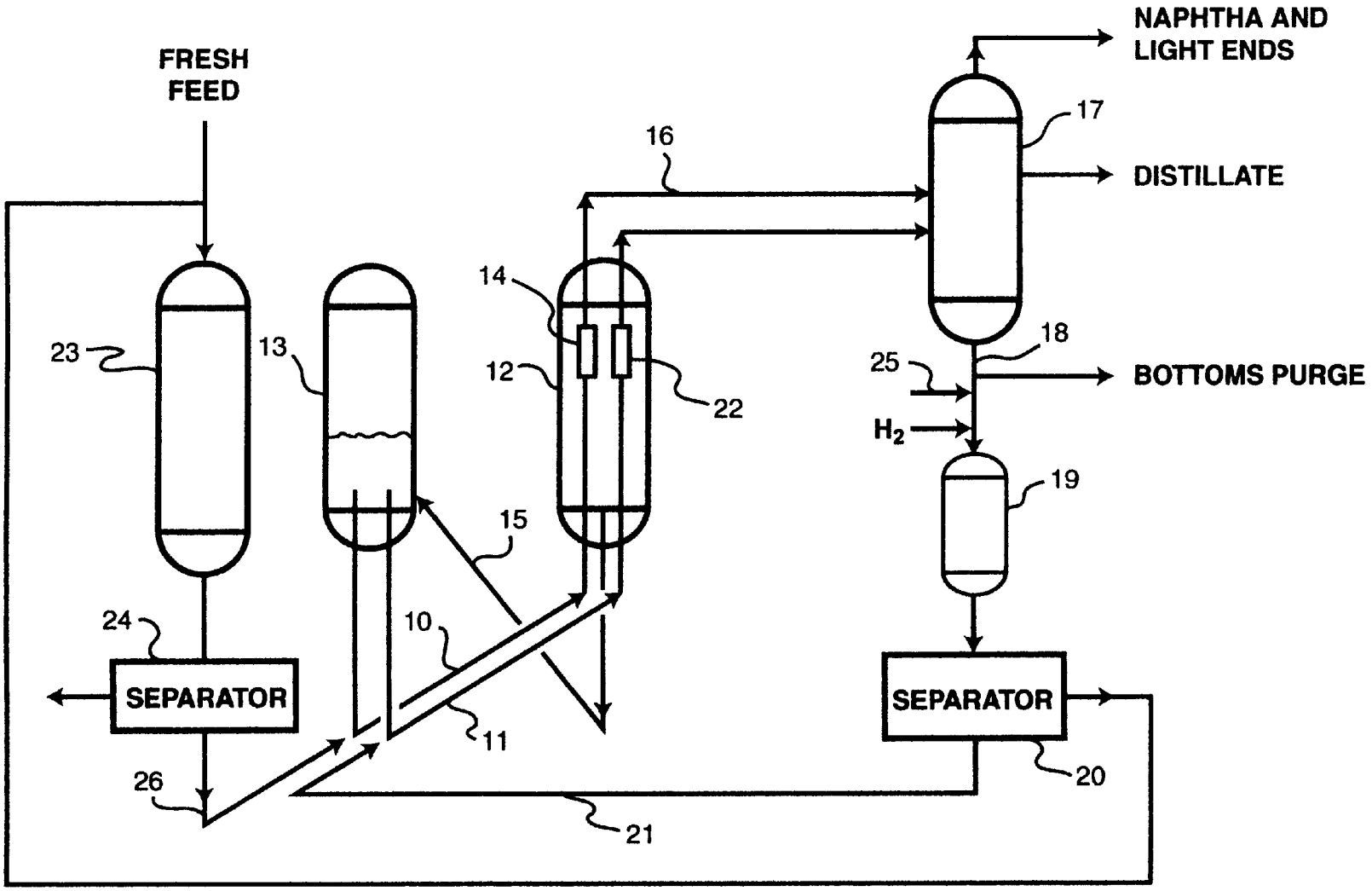
NAPHTHA AND LIGHT ENDS
DISTILLATE
BOTTOMS PURGE
FRESH FEED
SEPARATOR
SEPARATOR
$H_2$
10
11
12
13
14
15
16
17
18
19
20
21
22
23
24
25
26

INTEGRATED STAGED CATALYTIC CRACKING AND STAGED HYDROPROCESSING PROCESS

FIELD OF THE INVENTION

This invention relates to a staged catalytic cracking process that includes more than one catalytic cracking reaction step. In particular, this invention relates to a staged catalytic cracking process that integrates at least one hydroprocessing step before the catalytic cracking reaction steps, and at least one hydroprocessing step between the catalytic cracking reaction steps.

BACKGROUND OF THE INVENTION

Staged catalytic cracking reaction systems have been introduced to improve the overall gasoline yields and octane quality of gasoline. In recent times, however, environmental constraints have also had a large impact on the refiner. As a result, the known staged catalytic cracking processes are not sufficiently effective in concomitantly meeting environmental constraints and maintaining a high quality octane gasoline product.

U.S. Pat. No. 5,152,883 discloses a fluid catalytic cracking unit that includes two catalytic cracking reaction steps in series. After a hydrocarbon feed is cracked in a first catalytic cracking reaction step, light hydrocarbon gases and gasoline products are removed from the product stream and the heavier product portion is hydrotreated. Following hydrotreating and further gasoline product removal, the heavier hydrotreated product is cracked in a second catalytic cracking step. The gasoline products are removed and the heavier products are recycled into the hydrotreating process.

Rehbein et al., Paper 8 from Fifth World Petroleum Progress, Jun. 1–5, 1959, Fifth World Petroleum Congress, Inc., N.Y., pages 103–122 (which corresponds to U.S. Pat. No. 2,956,003, Marshall et al.), disclose a two stage catalytic cracking process which uses a short contact time riser as the first stage. The first stage is described as being designed to give 40–50 wt. % conversion. As set forth in the reference, the second stage is a dense bed system that uses gas oils from the first stage along with a recycle stream to give overall conversions of 63–72 wt. %, even though the unit is operated at low enough charge rates to achieve total conversions from 65–90 wt. %.

As set forth above, known catalytic cracking processes which have been integrated with hydrotreating processes are effective in significantly increasing gasoline yield and octane. However, this octane increase is obtained by sacrificing the quality of mid-distillates, which can be used as diesel or heating oil. Moreover, such processes undesirably produce a relatively high quantity of light saturated vapor products resulting from the detrimental hydrogen transfer from the heavier cracked products back to lighter olefin products. By minimizing the negative effects of this type of hydrogen transfer, a greater quantity of olefins product could be produced, and these olefins could be made available for further conversion into oxygenates and useful polymer materials.

The products of conventional FCC processes are generally low in hydrogen content resulting from both the relatively low feed hydrogen content and conventional FCC operating conditions of high temperature, (i.e., above 850° F.) and low pressure (i.e., below about 100 psig). The conventional processes consequently favor the formation of olefinic and aromatic products rather than aliphatic, or hydrogen-rich products. As recent environmental and regulatory pressures have resulted in requirements of higher hydrogen content fuels, especially in the diesel boiling range, a need for hydrogenation of FCC feedstocks and products has also grown. Moreover, there is a need for fuels having a diminished concentration of sulfur-containing species and, the value of FCC units as producers of olefinic gases for chemical feedstocks, e.g., propylene and ethylene, has grown. Hydrogenation technology can be employed to provide enrichment of the hydrogen content of FCC feeds. However, this hydrogen addition must be done wisely in order to maximize utilization of the hydrogen that is consumed and to minimize investment required for the hydrogenation step, while making the best use of FCC equipment as well. It is, therefore, desirable to obtain a combined staged catalytic cracking staged hydroprocessing process which maximizes olefins production, distillate quality and octane level.

SUMMARY OF THE INVENTION

In one embodiment, the invention provides a catalytic cracking process comprising the continuous steps of:

(a) contacting a hydrocarbon feed with a hydroprocessing catalyst under hydroprocessing conditions in order to form a hydroprocessed hydrocarbon feed, (b) contacting the hydroprocessed feed with cracking catalyst under catalytic cracking conditions forming a first cracked hydrocarbon product;

(c) separating from the first cracked hydrocarbon product a bottoms fraction containing mid-distillate and gas oil, the bottoms fraction having an initial boiling point of at least 300° F.;

(d) hydroprocessing the bottoms fraction under hydroprocessing conditions forming a hydroprocessed product;

(e) separating a second fraction of at least hydrogen from the hydroprocessed product, and combining the second fraction with the hydrocarbon feed of step (a);

(f) contacting the separated hydroprocessed product with cracking catalyst under catalytic cracking conditions forming a second cracked hydrocarbon product; and, (g) combining the first cracked hydrocarbon product and the second cracked hydrocarbon product for continued separation and hydroprocessing of the mid-distillate and gas oil containing bottoms fraction.

In a preferred embodiment of the invention, the second fraction comprises hydrogen, a C4-hydrocarbon fraction, and a mid distillate fraction.

In another preferred embodiment, less than 50 vol. % of the first cracked hydrocarbon product formed in step (b) has a boiling point of less than or equal to 430° F. It is further preferred that at least 60 vol. %, preferably at least 75 vol. %, of the combined first and second cracked hydrocarbon products have a boiling point of less than or equal to 430° F.

It yet another preferred embodiment, the catalytic cracking conditions of step (f) include a reaction temperature that is at least equal to that used under the catalytic cracking conditions of step (b). More preferably, the gas oil containing bottoms fraction and the cracking catalyst are contacted at a temperature that is up to 1000° F. higher than that used in step (b). More particularly, the hydrocarbon is contacted with the cracking catalyst at a temperature ranging from about 900° F. to about 1250° F.

In still another preferred embodiment, the hydrocarbon in step (b) is contacted with a zeolite cracking catalyst for less than five seconds. More preferably, the hydrocarbon is contacted with the zeolite catalyst for a time ranging from about 1 to about 2 seconds.

In yet another preferred embodiment of the invention, the feed and the cracking catalyst in both the first and second catalytic crackers are contacted at a temperature ranging from about 950° F. to about 1250° F.

BRIEF DESCRIPTION OF THE DRAWING

The present invention will be better understood by reference to the Detailed Description of the Invention when taken together with the attached drawing, wherein:

The FIGURE is a schematic representation of a preferred embodiment of the invention.

DETAILED DESCRIPTION OF THE INVENTION

Catalytic cracking is a process that is well known in the art of petroleum refining and generally refers to converting large hydrocarbon molecules to smaller hydrocarbon molecules by breaking at least one carbon to carbon bond. For example, a large paraffin molecule can be cracked into a smaller paraffin and an olefin, and a large olefin molecule can be cracked into two or more smaller olefin molecules. Long side chain molecules which contain aromatic rings or naphthenic rings can also be cracked.

It has been found that the quantity of light olefin product and the quality of distillate product that is formed during the catalytic cracking process can be improved by initially incorporating a short contact time reaction step into the overall catalytic cracking process. After the short contact time reaction step, a gas oil containing bottoms fraction is separated from the product portion, and the gas oil containing bottoms fraction is reprocessed at a higher intensity relative to that used in the short contact time reaction step.

According to this invention, product yield and quality are further enhanced by integrating staged hydroprocessing steps into the staged catalytic cracking process. Preferably, at least one hydroprocessing stage (the first hydroprocessing stage or stages) is included before the first catalytic cracking stage, and at least one additional hydroprocessing stage (the second hydroprocessing stages or stages) is included between the catalytic cracking stages. Separation stages may also be used in the practice of the invention, either alone or together with reaction stages. Combined separator-reactors, such as a combined hydroprocessor-separator wherein the hydroprocessing and separation occur in a single unit, are within the scope of the invention.

While not wishing to be bound by any theory, it is believed that the first hydroprocessing stage produces a hydroprocessed feed to the first catalytic cracking stage that has a diminished concentration of sulfur-containing and nitrogen-containing species. In addition to diminishing the concentration of sulfurbearing and nitrogen-bearing species, it is believed that the first hydroprocessing stage also removes some metals and saturates some of the aromatic and polar molecules that detrimentally affect the downstream catalytic cracking and hydroprocessing catalysts. It is believed that the lower sulfur and nitrogen enables operation of the second hydroprocessing stage with catalysts having higher hydrotreating, hydrocracking, or hydrogenation activity, or alternatively with multifunctional hydroprocessing catalysts. Diminishing sulfur and nitrogen concentration in the feed to the first catalytic cracker stage and removing some or all of the light cracked products such as C4-gases, naphtha, and mid-distillates from the products of the first catalytic stage may also result in elevated hydrogen partial pressure in the second hydroprocessing stage which in turn may result in increased aromatics hydrogenation.

In essence, the current invention takes advantage of an integration in which key chemistry synergies between FCC and hydrogenation technologies are exploited. A first FCC stage is operated at low enough severity, preferably with short contact time, to achieve high selectivity to olefin production while preserving sufficient aliphatic character in the unconverted mid-distillate and bottoms fractions. Operating the first FCC in this manner allows the unit to make acceptable quality distillate for distillate fuel blendstocks and an acceptable quality bottoms stream, which in turn enables moderate-severity hydroprocessing. At the same time, the first FCC step accomplishes two important benefits with respect to subsequent hydroprocessing: the most polar species in the feed from the first hydroprocessing stage are allowed to deposit on the FCC catalyst and are subsequently burned off the FCC catalyst in the regeneration step, providing heat for the endothermic FCC reactor chemistry. The presence of these polar species would otherwise result in severe hydroprocessing severity requirements in the second hydroprocessing stage (i.e., high pressure, large reactor volume. The second benefit derived from the first FCC stage is simple volume reduction. Accordingly, in the process of catalytically cracking the most easily cracked molecules in the FCC feed, the volume of feedstock remaining to be hydroprocessed in the second hydroprocessing stage is greatly reduced, and it is reduced to that population of molecules which are not easily converted in FCC, i.e., those molecules that will most benefit from the hydroprocessing chemistry that increases FCC feed crackability. Thus, the first FCC step selectively prepares a reduced-volume feed to the second hydroprocessing stage which contains a reduced amount of hydroprocessing catalyst poisons or inhibitors. As a result, the second hydroprocessing step can efficiently be directed to the task of facilitating and enhancing the selectivity of subsequent FCC conversion.

In conventional hydroprocessing, high purity hydrogen is obtained from the refinery hydrogen circuit, and unspent hydrogen is processed and returned to the refinery hydrogen circuit. Unspent hydrogen is hydrogen recovered from a hydroprocessing process that was not consumed, for example, for hydrogenating unsaturated species. However, in accordance with the practice of this invention, high purity hydrogen is used in the second hydroprocessing stage, and at least a portion of the unspent hydrogen from the second hydroprocessing stage is conducted to the first hydroprocessing stage and combined with the hydrocarbon feed. Accordingly, the second hydroprocessing stage has a high hydrogen partial pressure for hydrogenating any refractory aromatic molecules in the bottoms product of the first catalytic cracking stage. Unspent hydrogen from the second hydroprocessing stage is conducted to the first hydroprocessing stage, and is not purified and returned to the refinery hydrogen circuit. Hydrogen is utilized efficiently and economically because unspent hydrogen is routed directly to the first hydroprocessing stage. This invention thus produces a higher hydrogen partial pressure in the second hydroprocessing stage than in the first hydroprocessing stage. A higher hydrogen partial pressure is more critical in the second hydroprocessing stage to saturate the more refractory aromatic species and removing sulfur and nitrogen species.

Another aspect of the invention is to include the entire boiling range of unconverted bottoms from the first FCC step in the feed to the second hydroprocessing stage. This inclusion is effective because of the intentional low-intensity operation of the first FCC stage renders the bottoms suitable as a hydroprocessing feedstock. As a result of this selective conditioning of the second stage hydrotreater feed, the second hydroprocessing operating severity, e.g., operating pressure and reactor volume, is much less than would be considered necessary for hydroprocessing of a conventional FCC bottoms stream. The second stage hydroprocessing reactor conditions and catalyst can be selected to provide sufficient hydrogenation and/or hydrocracking to meet a wide range of operating objectives for the combined FCC-hydrotreating complex. A primary benefit of the second hydroprocessing stage of the first FCC stage bottoms is to interrupt the FCC chemistry at the point where there would be a significant decline in feed crackability upon further FCC processing, and to selectively insert hydrogen at that point into those unconverted molecules. Then subsequent FCC reactions can resume with a feedstock of increased crackability. By splitting the catalytic cracking into two stages, with hydrogen addition between stages, the right amount of hydrogen can be added to for example maximize the yield of light olefin species, e.g., butenes, propylene, and ethylene, in the subsequent FCC stage. With interstage hydroprocessing, both FCC stages could be operated at short contact times, to maximize light olefin yield. A related synergy in this approach is that it enables additional production of higher-hydrogen content mid-distillates, e.g., diesel and jet fuel components, by enabling short-contact time catalytic cracking, which limits hydrogen transfer reactions in the FCC reactor, that would otherwise increase dehydrogenation of distillates and hydrogenation of light olefins. Finally, the second FCC stage can perform the desired conversion of a reduced volume of more crackable FCC feed from the second hydroprocessing step. Without the interstage hydroprocessing of the bottoms, the severity required of the second FCC stage would be considerably higher, greatly reducing flexibility for achieving high yields of light olefins and high quality distillates, and increasing the yield of second-stage bottoms byproduct.

The preferred embodiment further optimizes the utilization of the integrated second hydroprocessing step by conducting mid-distillate produced in the catalytic cracking steps to the integrated hydroprocessing unit. As a result, the desulfurization of diesel product can be accomplished at the same time that the feed to subsequent FCC is made more crackable via hydrogenation. The desulfurized mid-distillate may be separated from the hydroprocessed bottoms from the second hydroprocessing stage via a separation step such as fractionation.

As described herein, the invention is a staged process that includes at least two hydrotreating steps and at least two catalytic cracking reaction steps, all steps preferably performed in series. The catalytic cracking reaction steps preferably take place in a fluid catalytic cracking system, which preferably comprises two or more main reaction vessels, two are more riser reactors which connect to one main reaction vessel, or a combination of multiple risers and reactor vessels.

In the first hydroprocessing stage of this invention, the hydrocarbon feed is preferably a petroleum hydrocarbon. The petroleum hydrocarbon is preferably a hydrocarbon fraction having an initial boiling point of at least about 400° F., more preferably at least about 600° F. As appreciated by those of ordinary skill in the art, such hydrocarbon fractions are difficult to precisely define by initial boiling point since there is some degree of variability in large commercial processes. Hydrocarbon fractions which are included in this range, however, are understood to include gas oils, thermal oils, residual oils, cycle stocks, topped and whole crudes, tar sand oils, shale oils, synthetic fuels, heavy hydrocarbon fractions derived from the destructive hydrogenation of coal, tar, pitches, asphalts, and mixtures thereof. Such feeds also include feed stocks derived from any of the foregoing, including feeds derived from hydroprocessing reactions.

The hydrotreated hydrocarbon feed is then directed to the first catalytic cracking stage where it is preferably introduced into a riser that feeds a catalytic cracking reactor vessel. Preferably, the hydrotreated feed is mixed in the riser with catalytic cracking catalyst that is continuously recycled. The hydrotreated hydrocarbon feed can be mixed with steam or an inert type of gas at such conditions so as to form a highly atomized stream of a vaporous hydrocarboncatalyst suspension. Preferably, this suspension flows through the riser into a reactor vessel.

Within the reactor vessel, the catalyst is separated from the hydrocarbon vapor to obtain the desired products, such as by using cyclone separators. The separated vapor comprises the cracked hydrocarbon product, and the separated catalyst contains a carbonaceous material (i.e., coke) as a result of the catalytic cracking reaction.

The coked catalyst is preferably recycled to contact additional hydrocarbon feed after the coke material has been removed. Preferably, the coke is removed from the catalyst in a regenerator vessel by combusting the coke from the catalyst under standard regeneration conditions. Preferably, the coke is combusted at a temperature ranging from about 900° to about 1400° F. and a pressure ranging from about 0 to about 100 psig. After the combustion step, the regenerated catalyst is recycled to the riser for contact with additional hydrocarbon feed. Preferably, the regenerated catalyst contains less than 0.4 wt. % coke, more preferably less than 0.1 wt. % coke.

The catalyst used in this invention can be any catalyst typically used to catalytically "crack" hydrocarbon feeds. It is preferred that the catalytic cracking catalyst comprise a crystalline tetrahedral framework oxide component. This component is used to catalyze the breakdown of primary products from the catalytic cracking reaction into clean products such as naphtha for fuels and olefins for chemical feedstocks. Preferably, the crystalline tetrahedral framework oxide component is selected from the group consisting of zeolites, tectosilicates, tetrahedral aluminophosphates (ALPOs) and tetrahedral silicoaluminophosphates (SAPOs). More preferably, the crystalline framework oxide component is a zeolite.

Zeolites that can be employed in accordance with this invention include both natural and synthetic zeolites. These zeolites include gmelinite, chabazite, dachiardite, clinoptilolite, faujasite, heulandite, analcite, levynite, erionite, sodalite, cancrinite, nepheline, lazurite, scolecite, natrolite, offretite, mesolite, mordenite, brewsterite, and ferrierite. Included among the synthetic zeolites are zeolites X, Y, A,L,ZK-4, ZK-5, B,E,F,H,J, M, Q,T,W,Z, alpha and beta, ZSM-types and omega.

In general, aluminosilicate zeolites are effectively used in this invention. However, the aluminum as well as the silicon component can be substituted for other framework components. For example, the aluminum portion can be replaced by boron, gallium, titanium or trivalent metal compositions that are heavier than aluminum. Germanium can be used to replace the silicon portion.

The catalytic cracking catalyst used in this invention can further comprise an active porous inorganic oxide catalyst framework component and an inert catalyst framework component. Preferably, each component of the catalyst is held together by attachment with an inorganic oxide matrix component.

The active porous inorganic oxide catalyst framework component catalyzes the formation of primary products by cracking hydrocarbon molecules that are too large to fit inside the tetrahedral framework oxide component. The active porous inorganic oxide catalyst framework component of this invention is preferably a porous inorganic oxide that cracks a relatively large amount of hydrocarbons into lower molecular weight hydrocarbons as compared to an acceptable thermal blank. A low surface area silica (e.g., quartz) is one type of acceptable thermal blank. The extent of cracking can be measured in any of various ASTM tests such as the MAT (microactivity test, ASTM# D3907-8). Compounds such as those disclosed in Greensfelder, B. S., et al., Industrial and Engineering Chemistry, pp. 2573–83, November 1949, are desirable. Alumina, silica-alumina and silica-alumina-zirconia compounds are preferred.

The inert catalyst framework component densifies, strengthens and acts as a protective thermal sink. The inert catalyst framework component used in this invention preferably has a cracking activity that is not significantly greater than the acceptable thermal blank. Kaolin and other clays as well as alpha-alumina, titania, zirconia, quartz and silica are examples of preferred inert components.

The inorganic oxide matrix component binds the catalyst components together so that the catalyst product is hard enough to survive interparticle and reactor wall collisions. The inorganic oxide matrix can be made from an inorganic oxide sol or gel which is dried to "glue" the catalyst components together. Preferably, the inorganic oxide matrix will be comprised of oxides of silicon and aluminum. It is also preferred that separate alumina phases be incorporated into the inorganic oxide matrix. Species of aluminum oxyhydroxides-g-alumina, boehmite, diaspore, and transitional aluminas such as alpha-alumina, beta-alumina, gamma-alumina, delta-alumina, epsilon-alumina, kappa-alumina, and rho-alumina can be employed. Preferably, the alumina species is an aluminum trihydroxide such as gibbsite, bayerite, nordstrandite, or doyelite.

In the staged catalytic cracking process incorporated into this invention, hydrocarbon feed is subjected to a first catalytic cracking reaction step, at least a portion of the product of the first reaction step is separated, and the separated portion is subjected to at least one additional catalytic cracking reaction step. Separation is preferably achieved using known distillation methods.

According to this invention, after the hydroprocessed hydrocarbon feed undergoes the first catalytic cracking reaction step, it is preferable to separate a mid-distillate and gas oil containing bottoms fraction from the product of the cracking reaction. The mid-distillate fraction preferably has an initial boiling point of at least about 300° F., more preferably at least about 350° F., and a final boiling point no more than about 800°F., preferably not more than about 700°0 F. The gas oil containing bottoms fraction is preferably a petroleum distillate fraction having an initial boiling point of at least 600° F., more preferably at least 650° F. The gas oil containing bottoms fraction is then used as the feed for at least one subsequent catalytic cracking reaction step. The remaining product portion of the first catalytic cracking reaction is sent to storage or subjected to further processing in other refinery processing units.

It is preferred in this invention that the mid-distillate and gas oil containing bottoms fraction be hydroprocessed prior to being subjected to any additional catalytic cracking steps. The mid-distillate and gas oil containing bottoms fraction is hydroprocessed by passing the fraction over a hydroprocessing catalyst in the presence of a hydrogen containing gas under hydroprocessing conditions.

As used herein, hydroprocessing includes both hydrotreating and mild hydrocracking, with mild hydrocracking indicating that sufficient cracking of 650° F.+ feed fraction has occurred such that there is a yield of greater than 15 wt. % and less than 50 wt. % of 650° F. −hydrocarbon material fraction from the cracking reaction. As is known by those of skill in the art, the degree of hydroprocessing can be controlled through proper selection of catalyst as well as by optimizing operation conditions.

It is particularly desirable in this invention that the hydroprocessing stages herein sufficiently saturate aromatic rings to form more easily crackable naphthenic rings. It is also desirable that the hydroprocessing stages convert unsaturated hydrocarbons such as olefins and diolefins to paraffins using a typical hydrogenation catalyst. Objectionable elements can also be removed by the hydroprocessing reactions. These elements include sulfur, nitrogen, oxygen, halides, and certain metals.

The hydroprocessing stages of the invention are performed under hydroprocessing conditions. Preferably, the reaction is performed at a temperature ranging from about 400° to about 900° F., more preferably from about 600° to about 850° F. The reaction pressure preferably ranges from about 100 to about 3000 psig, more preferably from about 500 to about 2000 psig. The hourly space velocity preferably ranges from about 0.1 to about 6 V/V/Hr, more preferably from about 0.3 to about 2 V/V/Hr, where V/V/Hr is defined as the volume of oil per hour per volume of catalyst. The hydrogen containing gas is preferably added to establish a hydrogen charge rate ranging from about 500 to about 15,000 standard cubic feet per barrel (SCF/B), more preferably from about 1000 to about 5000 SCF/B.

Hydroprocessing conditions can be maintained by use of any of several types of hydroprocessing reactors. Trickle bed reactors are most commonly employed in petroleum refining applications with co-current downflow of liquid and gas phases over a fixed bed of catalyst particles. It can be advantageous to utilize alternative reactor technologies. Countercurrent-flow reactors, in which the liquid phase passes down through a fixed bed of catalyst against upward-moving treat gas, can be employed to obtain higher reaction rates and to alleviate aromatics hydrogenation equilibrium limitations inherent in co-current flow trickle bed reactors. Moving bed reactors can be employed to increase tolerance for metals and particulates in the hydrotreater feed stream. Moving bed reactor types generally include reactors wherein a captive bed of catalyst particles is contacted by upward-flowing liquid and treat gas. The catalyst bed can be slightly expanded by the upward flow or substantially expanded or fluidized by increasing flow rate, for example, via liquid recirculation (expanded bed or ebullating bed), use of smaller size catalyst particles which are more easily fluidized (slurry bed), or both. In any case, catalyst can be removed from a moving bed reactor during onstream operation, enabling economic application when high levels of metals in feed would otherwise lead to short run lengths in the alternative fixed bed designs. Furthermore, expanded or slurry bed reactors with upward-flowing liquid and gas phases would enable economic operation with feedstocks containing significant levels of particulate solids, by permitting long run lengths without risk of shutdown due to fouling. Use of such a reactor would be especially beneficial in cases where the feedstocks include solids in excess of about 25 micron size, or contain contaminants which increase the propensity for foulant accumulation, such as olefinic or diolefinic species or oxygenated species. Moving bed reactors utilizing downward-flowing liquid and gas can also be applied, as they would enable on-stream catalyst replacement.

The catalyst used in the hydroprocessing stages can be any hydroprocessing catalyst suitable for aromatic saturation, desulfurization, denitrogenation or any combination thereof. Preferably, the catalyst is comprised of at least one Group VIII metal and a Group VI metal on an inorganic refractory support, which is preferably alumina or alumina-silica. The Group VIII and Group VI compounds are well known to those of ordinary skill in the art and are well defined in the Periodic Table of the Elements. For example, these compounds are listed in the Periodic Table found at the last page of Advanced Inorganic Chemistry, 2nd Edition 1966, Interscience Publishers, by Cotton and Wilkenson. The Group VIII metal is preferably present in an amount ranging from 2–20 wt. %, preferably 4–12 wt. %. Preferred Group VIII metals include Co, Ni, and Fe, with Co and Ni being most preferred. The preferred Group VI metal is Mo which is present in an amount ranging from 5–50 wt. %, preferably 10–40 wt. %, and more preferably from 20–30 wt. %.

All metals weight percents given are on support. The term "on support" means that the percents are based on the weight of the support. For example, if a support weighs 100 g, then 20 wt. % Group VIII metal means that 20 g of the Group VIII metal is on the support.

Any suitable inorganic oxide support material may be used for the catalyst of the present invention. Preferred are alumina and silica-alumina, including crystalline aluminosilicate such as zeolite. More preferred is alumina. The silica content of the silica-alumina support can be from 2–30 wt. %, preferably 3–20 wt. %, more preferably 5–19 wt. %. Other refractory inorganic compounds may also be used, non-limiting examples of which include zirconia, titania, magnesia, and the like. The alumina can be any of the aluminas conventionally used for hydroprocessing catalysts. Such aluminas are generally porous amorphous alumina having an average pore size from 50–200 Å, preferably, 70–150 Å, and a surface area from 50–450 $m^2/g$.

In the staged catalytic cracking process of this invention, a short contact time reaction step is preferably included. In the short contact time reaction step, it is preferable that the hydrotreated hydrocarbon feed contacts the cracking catalyst under catalytic cracking conditions to form a first cracked hydrocarbon product. It is also preferred that the catalytic cracking conditions are controlled so that less than 50 vol. % of the first cracked hydrocarbon product has a boiling point below about 430° F. More preferably, catalytic cracking conditions are controlled so that 25–40 vol. % of the first cracked hydrocarbon product has a boiling point equal to or below about 430° F.

The 430° F. boiling point limitation is not per se critical, but is used to give a general indication of the amount of gasoline and high quality distillate type products that are formed in the short contact time reaction step. In the short contact time reaction step, therefore, it is desirable to initially limit the conversion to gasoline and high quality distillate type products. By controlling the conversion in this step, hydrogen transfer can be minimized.

According to this invention, short contact time means that the hydrocarbon feed will contact the cracking catalyst for less than about five seconds. Preferably, in the short contact time reaction step, the hydrocarbon feed will contact the cracking catalyst for 1–4 seconds.

The short contact time reaction step can be achieved using any of the known processes. For example, in one embodiment a close coupled cyclone system effectively separates the catalyst from the reacted hydrocarbon to quench the cracking reaction. See, for example, Exxon's U.S. Pat. No. 5,190,650, of which the detailed description is incorporated herein by reference.

Short contact time can be achieved in another embodiment by injecting a quench fluid directly into the riser portion of the reactor. The quench fluid is injected into the appropriate location to quench the cracking reaction in less than one second. See, for example, U.S. Pat. No. 4,818,372, of which the detailed description is incorporated herein by reference. Preferred as a quench fluid are such examples as water or steam or any hydrocarbon that is vaporizable under conditions of injection, and more particularly the gas oils from or visbreaking, catalytic cycle oils, and heavy aromatic solvents as well as certain deasphalted fractions extracted with a heavy solvent.

In yet another embodiment, short contact time can be achieved using a downflow reactor system. In downflow reactor systems, contact time between catalyst and hydrocarbon can be as low as in the millisecond range. See, for example, U.S. Pat. Nos. 4,985,136, 4,184,067 and 4,695,370, of which the detailed descriptions of each are incorporated herein by reference.

The particular catalytic cracking conditions used to achieve conversion to a product in which less than 50 vol. % of the product has a boiling point less than 430° F. are readily obtainable by those of ordinary skill in the art. Once the preferred particular cracking catalyst is chosen, the operations parameters of pressure, temperature and vapor residence time are optimized according to particular unit operations constraints. For example, if it is desired to use a zeolite type of cracking catalyst, the short contact time reaction step will typically be carried out at a pressure ranging from about 0 to about 100 psig (more preferably from about 5 to about 50 psig), a temperature ranging from about 900° to about 1150° F. (more preferably from about 950° to about 1100° F.), and a vapor residence time of less than five seconds.

Regardless of the type of quenching step used to achieve the short contact time reaction, the catalyst is separated from the vapor to obtain the desired products according to the known processes, such as by using cyclone separators. The separated vapor comprises the cracked hydrocarbon product, and the separated catalyst contains a carbonaceous material (i.e., coke) as a result of the catalytic cracking reaction.

The products recovered from the short contact time reaction step may be separated and a mid-distillate and gas oil-containing bottoms fraction may be recovered for the second hydroprocessing stage and additional cracking. Alternatively, the mid-distillate boiling fraction is separated and removed for storage or further processing. Preferably, the mid-distillate and gas oil containing bottoms fraction contains a mid-distillate having an initial boiling point of at least 300° F., more preferably an initial boiling point of at least 350° F.

After the mid-distillate and gas oil containing bottoms fraction is separated, it is preferably hydroprocessed in the second hydroprocessing stage and then separated to recover unspent hydrogen, hydroprocessed light ends, naphtha, and mid-distillate products. A stream comprising the recovered unspent hydrogen fraction is then conducted to the first hydroprocessor and combined with the feed. In some cases it is desirable for the stream to contain recovered naphtha and middistillate fractions. Alternatively, the naphtha and mid-distillate products separated from the products of the second hydroprocessing stage may be removed as products for further processing or storage. In another embodiment, the naphtha separated from the product of the second hydroprocessing stage is conducted to the second catalytic cracking stage. In this embodiment, the high boiling end of the naphtha product is further cracked in order to produce a "light" naphtha. In general, the particular embodiment employed will depend on the equipment used, such as the type of separation equipment employed following the second hydroprocessor. Importantly, though, in all embodiments hydrogen recovered from the second hydroprocessor is routed to the first hydroprocessor and combined with the hydrocarbon feed.

Gas oil-containing bottoms from the second hydroprocessor are subjected to at least one subsequent cracking step with a cracking catalyst under catalytic cracking conditions which favor cracking of the heavier hydrocarbons contained in the bottoms fraction. It is preferred in any subsequent cracking step following the second hydroprocessing stage that the reaction time be longer and the reaction temperature be at least equal to that used in the short contact time reaction step. The appropriate catalytic cracking conditions employed following the short contact time reaction step are preferably controlled so that the combined products of all of the cracking steps will yield an overall product in which at least 60 wt. %, preferably at least 75 vol. %, and more preferably at least 85 vol. % of the overall product has a boiling point of less than or equal to about 430° F. In any cracking steps following the hydroprocessing step, the conditions which are used to achieve the desired overall product boiling point characteristics are readily obtainable by those of ordinary skill in the art and are optimized according to the needs of the specific operating unit. Since the same catalyst is generally used in the short contact time reaction step as in a subsequent cracking reaction step, it is preferred to increase slightly severity of the reaction conditions in the subsequent reaction step. Preferably, this is done by increasing the temperature or vapor contact time, or both, in the subsequent reaction step, while maintaining reaction pressures similar to that in the first catalytic cracking step, although reaction pressures can be adjusted without changing temperature or vapor contact time. For example, when using a zeolite type of cracking catalyst, it is preferred to have a vapor residence time of less than 10 seconds, more preferably a vapor residence time of 2–8 seconds.

Depending upon the quality of the feed, severity of the second hydroprocessing stage and the particular reaction equipment used, it can be desirable to increase the temperature of a subsequent catalytic cracking reaction step. Preferably, any temperature increase will be less than about 1000° F. higher than in the first catalytic cracking reaction step and in a range of about 950°–1250° F.

Although it is preferred to slightly increase the severity of any cracking reaction subsequent to the initial short contact time reaction step, this is not necessary. In general, the more intense the second hydroprocessing stage, the less intense can be any subsequent cracking steps.

A preferred embodiment of the invention is shown in the FIGURE. The first hydrotreating stage is carried out in hydrotreater 23. The product of hydrotreater 23 may be separated in separator 24 into lower boiling point streams such as light ends, naphtha, and distillate which may then be diverted for storage or further processing. The content of any lower boiling point streams may depend on factors such as the type of separation equipment employed. Hydrotreated bottoms from the separator are routed for feed to the first catalytic cracking stage. Though preferred, the separator 24 is not required, and all of the first hydroprocessor's products may be conducted as feed to the first catalytic cracking stage.

The cracking reaction is carried out using dual risers 10, 11 and a single reactor 12, with the spent catalyst being regenerated in a single regenerator 13. Although a dual riser with single reactor design is shown as one preferred embodiment, the process of this invention can be carried out using more than one reactor or more than two risers.

In the FIGURE, hydrotreated hydrocarbon feed is injected into the riser 10 where it contacts hot catalyst from the regenerator 13. The reaction is preferably quenched using a cyclone separator 14 to separate the hydrocarbon material from the spent catalyst. The spent catalyst falls through a stripper and standpipe and is carried through a return line 15 to the regenerator 13 where it is regenerated for further use.

Cracked hydrocarbon product is removed from the cyclone 14 by way of a line 16 that leads to a separation vessel 17. The separation vessel 17 is used to separate a mid-distillate and gas oil containing bottoms fraction from a naphtha and light ends fraction. As stated above, operating conditions within the riser 10 are maintained such that less than 50 vol. % of the cracked hydrocarbon product from riser 10 has a boiling point of less than or equal to 430° F.

The mid-distillate and gas oil-containing bottoms fraction is removed from the separation vessel by way of a line 18. As the mid-distillate and gas oil containing bottoms fraction is transported through line 18, a hydrogen-containing gas stream is injected at the desired rate, and the entire mixture is sent to a second hydroprocessing reactor 19. The second hydroprocessing reactor 19 contains a hydroprocessing catalyst, and the hydroprocessing reaction is carried out under hydroprocessing conditions, utilizing a fixed or moving bed of hydroprocessing catalyst.

In another embodiment the mid-distillate fraction is removed as a product from separator 17 for storage or further processing. In this embodiment, the gas oil bottoms from separator 17 do not contain mid-distillate.

Following the second hydroprocessing reaction, a hydrogen-containing treat gas is separated from the lightend products of the second hydroprocessor. The hydrogen-containing treat gas comprises unspent hydrogen from the second hydroprocessor. It may further comprise a C4-hydrocarbon fraction, e.g., a hydrocarbon fraction containing C4 and lighter hydrocarbons and other gases boiling below about 60° F. The hydrogen-containing treat gas is conducted via line 20 to the first hydrotreater, where it is combined with the fresh feed. Separator 20 separates the hydroprocessed, gas oil-containing bottoms fraction from the second hydroprocessor's products. The hydroprocessed, gas oil-containing bottoms fraction is routed as a feed to the second catalytic cracking stage via line 21. In addition to unspent hydrogen, a light ends fraction, a naphtha fraction, and a middistillate fraction may also be separated from the hydroprocessed gas oilcontaining bottoms product in separator 20. The naphtha fraction includes a hydrocarbon fraction preferably within a boiling point range of C4 (about 60° F.) to less than about 430° F. The mid-distillate fraction has a boiling point range of about 350°0 F. to less than about 700° F. The separated light ends, naphtha, and distillate may be returned to the first hydroprocessing stage for combining with the fresh feed. Alternatively, they may be diverted for storage or further processing.

In a related embodiment, the naphtha separated from the product of the second hydroprocessing stage is routed to the second cat cracking stage. In this embodiment, the high boiling end of the naphtha is cracked to produce a "light" naphtha.

The separator 20 can be any type of separation equipment capable of effectively separating the hydroprocessed product into its component parts. For example, separator 20 can be a simple fractionator or could be a series of collection vessels such as a hot separator vessel followed by a cold separator vessel followed by a fractionator.

After separation, the hydroprocessed, gas oil-containing bottoms fraction is injected into riser 11 for further catalytic cracking through a line 21. A portion of the hydroprocessed bottoms can be withdrawn as a purge stream in a line. The cracking reaction in riser 11 is quenched by separating the cracked products from the spent catalyst using a cyclone separator 22. The spent catalyst is combined with the spent catalyst that is separated using the cyclone separator 14, and is sent through the return line 15 to the regenerator 13 where it is regenerated for further use. The cracked product is sent to the separator 17 where it is combined with the cracked product from cyclone separator 14. Alternatively, the cracked product may be combined with the hydroprocessed product from second hydroprocessing reactor 19 and sent to separator 20 or separator 24.

Because the second hydroprocessing step removes undesirable contaminants and improves the quality of the feed to the riser 11, other petroleum distillate fractions can be combined with the mid-distillate and gas oil containing bottoms fraction prior to hydroprocessing such as by line 25. These other petroleum distillate fractions include petroleum fractions that are generally high in contaminant content, and typically would not be directly processed in a catalytic cracking reactor. An example of such petroleum distillate fractions includes heavy coker oil streams.

Having now fully described this invention, it will be appreciated by those skilled in the art that the invention can be performed within a wide range of parameters within what is claimed:

What is claimed is:

1. A catalytic cracking process for producing high quality mid-distillates comprising the continuous steps of:

(a) contacting a hydrocarbon feed having an initial boiling point of at least about 400° F. with a hydroprocessing catalyst under hydroprocessing conditions in a first hydroprocessor in order to form a first hydroprocessed hydrocarbon;

(b) conducting at least a portion of the first hydroprocessed hydrocarbon to a first catalytic cracker and contacting the portion of the first hydroprocessed hydrocarbon with cracking catalyst under catalytic cracking conditions wherein the temperature is from 900° to 1150° F. and the catalyst contact time is less than 5 seconds in order to form a first cracked hydrocarbon product;

(c) conducting the first cracked hydrocarbon product to a first separator and separating from the first cracked hydrocarbon product at least a first naphtha fraction, a first light ends fraction, and a gas oil-containing bottoms fraction having an initial boiling point of at least 300° F.;

(d) conducting at least the gas oil-containing bottoms fraction to a second hydroprocessor and hydroprocessing gas oil-containing bottoms fraction under hydroprocessing conditions in order to form a second hydroprocessed hydrocarbon, wherein the second hydroprocessor has a higher hydrogen partial pressure than the first hydroprocessor;

(e) conducting the second hydroprocessed hydrocarbon to a second separator; separating at least a fraction containing unspent hydrogen and a hydroprocessed, gas oil-containing bottoms fraction; and combining at least the fraction containing unspent hydrogen with the hydrocarbon feed of step (a);

(f) conducting at least the hydroprocessed, gas oil-containing bottoms fraction to a second catalytic cracker and contacting the hydroprocessed, gas oil-containing bottoms fraction with cracking catalyst under catalytic cracking conditions wherein the temperature is from 950° to 125° F. in order to form a second cracked hydrocarbon product; and, (g) combining the first cracked hydrocarbon product and the second cracked hydrocarbon product for continued separation and hydroprocessing of at least the gas oil-containing bottoms fraction.

2. The catalytic cracking process of claim 1, wherein the first light ends fraction is a C4-hydrocarbon fraction.

3. The catalytic cracking process of claim 1, wherein less than 50 vol. % of the first cracked hydrocarbon product formed in step (b) has a boiling point of less than or equal to 430° F.

4. The catalytic cracking process of claim 1, wherein at least 60 vol. % of the combined first and second cracked hydrocarbon products have an overall boiling point of less than or equal to 430° F.

5. The catalytic cracking process of claim 1, wherein the catalytic cracking conditions of step (f) include a reaction temperature that is at least equal to that used under the catalytic cracking conditions of step (b).

6. The catalytic cracking process of claim 1, wherein the portion of the first hydroprocessed hydrocarbon is contacted with cracking catalyst for less than 2 seconds.

7. The catalytic cracking process of claim 1, wherein the first and second hydroprocessor stage are independently at least one of a trickle bed, countercurrent, moving bed, expanded bed and slurry bed reactor.

8. The catalytic cracking process of claim 1 wherein the unspent hydrogen-containing fraction further comprises hydroprocessed light ends and hydroprocessed naphtha.

9. The catalytic cracking process of claim 1 farther comprising separating a first mid-distillate fraction from the first cracked hydrocarbon and a hydroprocessed mid-distillate fraction from the second hydroprocessed hydrocarbon.

10. The catalytic cracking process of claim 1 further comprising separating a hydroprocessed naphtha fraction from the second hydroprocessed hydrocarbon and combining the hydroprocessed naphtha fraction with the hydroprocessed, gas oil-containing bottoms fraction.

11. The catalytic cracking process of claim 1 further comprising conducting the first hydroprocessed hydrocarbon to a third separator located in series between the first hydroprocessor and the first catalytic cracker and separating from the first hydroprocessed hydrocarbon at least a second unspent hydrogen-containing fraction.

12. The catalytic cracking process of claim 11 further comprising separating from the first hydroprocessed hydrocarbon at least a mid-distillate fraction.

13. The catalytic cracking process of claim 12 further comprising separating from the first hydroprocessed hydrocarbon at least a second light ends fraction.

14. The catalytic cracking process of claim 13 further comprising separating from the first hydroprocessed hydrocarbon at least a second naphtha fraction.

* * * * *